United States Patent [19]

Katoh et al.

[11] 4,384,785

[45] May 24, 1983

[54] CHARGE QUENCHING APPARATUS FOR ELECTROPHOTOGRAPHIC COPYING MACHINE

[75] Inventors: Shunji Katoh, Sagamihara; Hidefumi Nishitsuji, Kawasaki, both of Japan

[73] Assignee: Ricoh Company, Ltd., Japan

[21] Appl. No.: 194,230

[22] Filed: Oct. 6, 1980

[30] Foreign Application Priority Data

Oct. 19, 1979 [JP] Japan ..... 54-134873

[51] Int. Cl.[3] ..... G03G 15/04; G03G 15/22

[52] U.S. Cl. ..... 355/14 CH; 355/3 TR; 355/3 CH; 355/14 E

[58] Field of Search ..... 355/3 R, 3 CH, 3 TR, 355/14 CH, 14 E

[56] References Cited

U.S. PATENT DOCUMENTS 3,967,896 7/1976 Looney et al. ..... 355/3 R X 4,236,811 12/1980 Hirose et al. ..... 355/3 CH X

*Primary Examiner*—Fred L. Braun

*Attorney, Agent, or Firm*—Guy W. Shoup; Gerard F. Dunne; Eliot S. Gerber

[57] ABSTRACT

A charge quenching apparatus for quenching unnecessary charges on a latent electrostatic-image bearing photoconductor of an electrophotographic copying machine for making copies with clean margins when the size of the maximum-latent-image area on the photoconductor, corresponding to the size of the original, is smaller than the transfer sheet employed, in the unit magnification and in the variable magnification, and for making copies without applying excess load to a cleaning apparatus of the photoconductor when copies bearing part of the image of the original are made or when copies bearing a reduced-size image of the original are made. In the charge quenching apparatus, the size of the maximum-latent-image area selected and the size of the transfer sheet selected are compared, and charges in the area outside the area corresponding to the smaller size determined by the above-mentioned comparison are quenched.

4 Claims, 5 Drawing Figures

CHARGE QUENCHING APPARATUS FOR ELECTROPHOTOGRAPHIC COPYING MACHINE

BACKGROUND OF THE INVENTION

The present invention relates to a charge quenching apparatus for quenching unnecessary charges on a photoconductor of an electrophotographic copying machine when making copies and more particularly to a charge quenching apparatus for an electrophotographic copying machine capable of making copies with unit magnification and variable magnification.

In a convention electrophotographic copying machine of the above-mentioned type, the surface of a photoconductor is uniformly charged and exposed to the optical image of an original to form a latent electrostatic image on the photoconductor, corresponding to the optical image, and the latent electrostatic image is developed by a developer, rendering the image visible.

In a conventional electrophotographic copying machine, when an original is copied with unit magnification, using a transfer sheet larger than the original, the area of the transfer sheet in excess of the size of the original can be rendered pure white if the original placed on the contact glass of the electrophotographic copying machine is covered closely by an original pressure plate with a white contact surface. In that case, light from an exposure lamp reflected from the white contact surface reaches the outside area of the photoconductor, around the area corresponding to the original, thus completely quenching the unnecessary charges in that outside area, so that a copy of a larger sheet than the original, with a blank margin, can be obtained.

However, when the contact surface of the original pressure plate is darker than the background of the original, or happens to be dirty or stained, an inevitable occurs in practice, or when the original placed on the contact glass is a book or the like and the original pressure plate cannot be closed completely, the unnecessary charges in the outside area of the photoconductor around the area corresponding to the original will not be quenched completely, so that toner will be deposited there to some degree, and copies with dirty or dark margins will be obtained.

Obviously, such margins should be eliminated from the copies as much as possible.

In addition, in unit magnification, in a conventional electrophotographic copying machine of the type in which the maximum size of the latent electrostatic image to be formed on the photoconductor is not determined in accordance with the size of the transfer sheet selected, i.e., when the maximum possible size of the photoconductor is always initially charged, then when a transfer sheet smaller than the maximum is used, a latent electrostatic image as large as the maximum-latent-image size is nevertheless formed on the photoconductor and developed, with only a part of the developed toner image of a size equal to that of the transfer sheet being transferred to the transfer sheet. Therefore, the unnecessary toner deposited outside the area corresponding to the transfer sheet has to be removed from the photoconductor. As a result, toner is wasted and excess load is applied to the cleaning apparatus when cleaning the photoconductor.

Further, when a copy reduced in size in comparison with the original is made with variable magnification, the maximum latent electrostatic image area on the photoconductor, which may corrspond to the whole surface of the contact glass covered by the original pressure plate, is also reduced in size, and charges in the non-image area outside the maximum latent electrostatic image area remain on the photoconductor without being quenched, as if such outside area were pure black since no light reaches the outside area. Therefore, when development is performed, a large quantity of toner is deposited in that area, is wasted, and must be removed, with excess load applied to the cleaning apparatus of the copying machine.

SUMMARY OF THE INVENTION

It is therefore an object of the invention to provide a charge quenching apparatus for quenching unnecessary charges on a latent-electrostatic-image-bearing photoconductor of an electrophotographic copying machine, for making copies with clean margins when the size of the maximum-latent-image area on the photoconductor, corresponding to the size of the original, is smaller than the transfer sheet employed, in the unit magnification and in variable magnification, and for making copies without applying excess load to a cleaning apparatus of the photoconductor when copies bearing part of the image of the original are made or when copies bearing a reduced-size image of the original are made.

According to the invention, the size of the maximum-latent-image area selected and the size of the transfer sheet selected are compared, and charges in the area outside the area corresponding to the smaller size determined by the above-mentioned comparison are quenched, so that copies with clean margins are always obtained regardless of the difference in size between the original and the transfer sheet. In particular, when a copy is made from part of an original which is larger than the copy size, or when copies with images reduced in size relative to the size of the original image are made, since charges on the photoconductor unnecessary for making such copies are quenched prior to development, no toner is wasted and no excess load is applied to the cleaning apparatus of the photoconductor.

DETAILED DESCRIPTION OF THE PREFERRED EMBODIMENT

Figure 1:
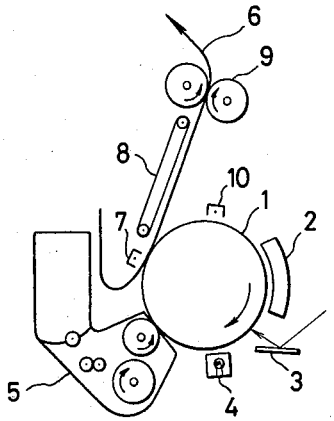
FIG. 1 is a schematic view of an electrophotographic copying machine in which a charge quenching apparatus according to the invention is employed.

Referring to FIG. 1, there is diagrammatically shown an electrophotographic copying machine in which a charge quenching apparatus 4 according to the invention is employed. In FIG. 1, a photoconductor drum 1 is rotated in the direction of the arrow. The surface of the photoconductor drum 1 is uniformly charged by a charging device 2. The optical image of an original placed on the contact glass (not shown) of the copying machine is then projected to the surface of the photoconductor 1 by a conventional exposure apparatus comprising a reflector 3, whereby a latent electrostatic image corresponding to the optical image of the original is formed on the photoconductor 1. The charge quenching apparatus 4 for quenching unnecessary charges on the photoconductor 1 is disposed between the charging device 2 and a development apparatus 5. The operation of the charge quenching apparatus 4 is controlled by a control apparatus 11 in such a manner that (i) the size of the transfer sheet selected and (ii) the selected maximum-latent-image size to be formed on the photoconductor 1 are compared, and the area to remain unquenched on the photoconductor 1 by the charge quenching apparatus 4 is determined to be of the same size as the smaller of sizes (i) and (ii) and charges in the remaining portion of the photoconductor 1 are quenched. The aforementioned "maximum-latent-image size" will be discussed in detail later.

The charge quenching apparatus 4 can be disposed between the charging divice 2 and the exposure apparatus in order to quench the unnecessary charges on the photoconductor 1 between the charging step and the exposure step. The latent electrostatic image formed on the photoconductor 1 is then developed to a toner image by the development apparatus 5. A transfer sheet 6 with the selected size is fed from a cassette or the like so as to come in contact with the toner-image bearing surface of the photoconductor 1, so that the toner image is transferred to the transfer sheet 6 by an image transfer charger 7. The transfer sheet 6 is then transported by a sheet transportation belt 8 to an image fixing apparatus 9, where the toner image is fixed to the transfer sheet 7. The transfer sheet 7 is then discharged from the copying machine. After this copying process, the residual toner is removed from the photoconductor 1 by a cleaning apparatus (not shown) and the residual charges on the photoconductor 1 are quenched by a quenching charger 10 for the next copying process.

The aforementioned maximum-latent-image size on the photoconductor 1 means the size of the area on the photoconductor 1 in which a latent electrostatic image can be formed, for instance, B4, A4 or B5 size, by the operator's choice. For instance, in a unit magnification mode, when A4 size is selected as the maximum-latent-image size by the operator, which may be equal to the size of the original to be copied, and B4 size transfer sheet are set in a cassette of the copying machine, the A4 size and the B4 size are compared and the smaller size, A4, is selected by the control apparatus 11, so that charges outside the maximum-latent-image size area on the photoconductor 1 are completely quenched between the initial uniform charging of the photoconductor 1 and the development. As a result, a B4 copy with a clear margin, bearing an image of equal size to that of the image of the original, can be obtained.

Further, in the unit magnification mode, when B4 size is selected as the maximum-latent-image size and A4 size transfer sheets are set in the copying machine, the B4 size and the A4 size are compared and the smaller size, A4, is selected by the control apparatus 11. In this case, although the maximum-latent-image size on the photoconductor 1 is B4, since the selected transfer sheet is of A4 size, charges in the portion outside the A4 size area on the photoconductor 1 are completely quenched between the initial uniform charging of the photoconductor 1 and the development. Therefore, no toner is deposited on the marginal area of the maximum-latent-image size area and, accordingly, no toner is wasted and no excess load is applied to the cleaning apparatus when cleaning the photoconductor 1.

In a variable magnification mode for reducing the size of the image of the original, for instance, from B4 size to A4 size, from A4 to B5, or from B4 to B5, their maximum-latent-image sizes on the photoconductor 1 are respectively A4, B5 and B5 sizes. Any of these reduction can be selected by the operator.

For example, when the reduction ratio from B4 to A4 size is selected and a B4 size transfer sheet is set in the copying machine, the A4 and the B4 size are compared and the A4 size is determined to be of the smaller size by the control apparatus 11, so that charges in the area outside the A4 size area on the photoconductor 1 are completely quenched by the charge quenching apparatus 4. As a result, a B4 size copy without any dark margin can be obtained.

Further, in the variable magnification mode, when the reduction ratio from B4 to A4 is selected and B5 transfer sheets are set in the copying machine, the A4 and the B5 size are compared, and the B5 size is determined to be the smaller size by the control apparatus 11. Accordingly, charges in the area outside the B5 size area on the photoconductor 1 are quenched between the initial uniform charging of the photoconductor 1 and the development, whereby only the latent electrostatic image in the B5 size area is developed and, therefore, no toner is wasted and no excess load is applied to the cleaning apparatus when cleaning the photoconductor 1.

Figure 2:
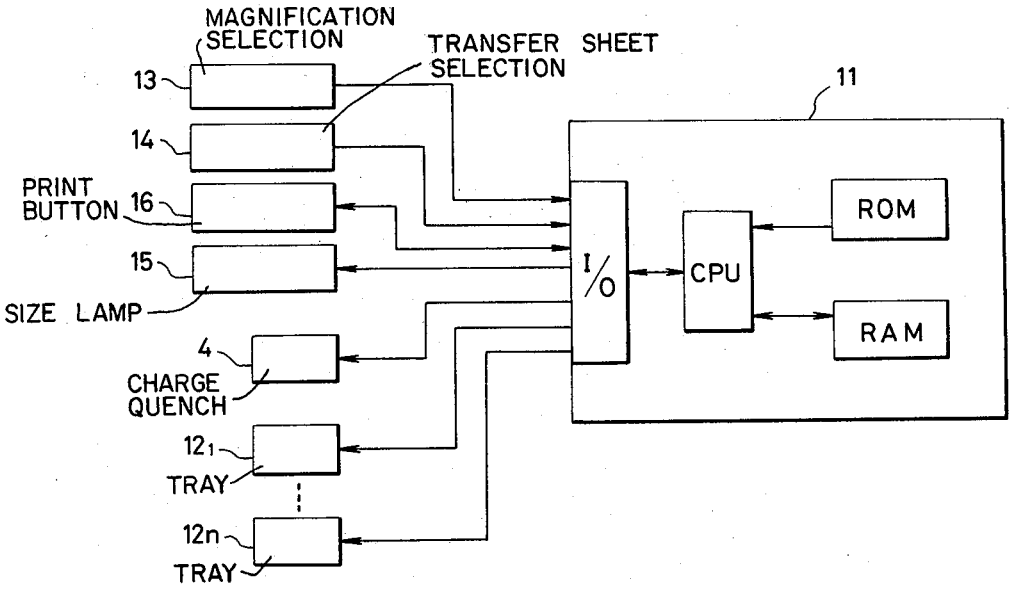
FIG. 2 is a block diagram of part of the electrophotographic copying machine in FIG. 1.

Referring to FIG. 2, there is shown a partial block diagram of the control apparatus 11 of the above-mentioned copying machine. As shown in FIG. 2, the control apparatus 11 is constructed of a micro-processor unit comprising a central processing unit (CPU), a read-only memory (ROM), a random access memory (RAM) and a an input-output port (I/O). The input-output lead lines of the control apparatus 11 are each connected to the sheet feed trays or cassettes $12_1$–$12_n$, each of which holds transfer sheets with different sizes, and to the charge quenching apparatus 4.

Figure 4:
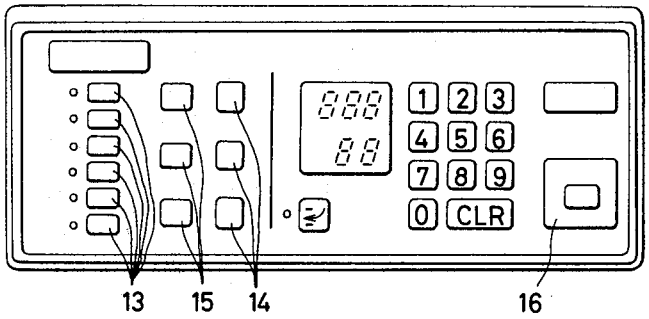
FIG. 4 is a plan view of the operation section of the copying machine in FIG. 1.

Referring to FIG. 4, there is shown an operation section of the copying machine, in which magnification selection buttons 13 for selecting the desired maximum-latent-image size on the photoconductor 1, transfer sheet selection buttons for selecting the transfer sheets with the desired size from the cassettes $12_1$–$12_n$, cassette size indication lamps 15 for indicating the selected cassette, and a print button.

Figure 3:
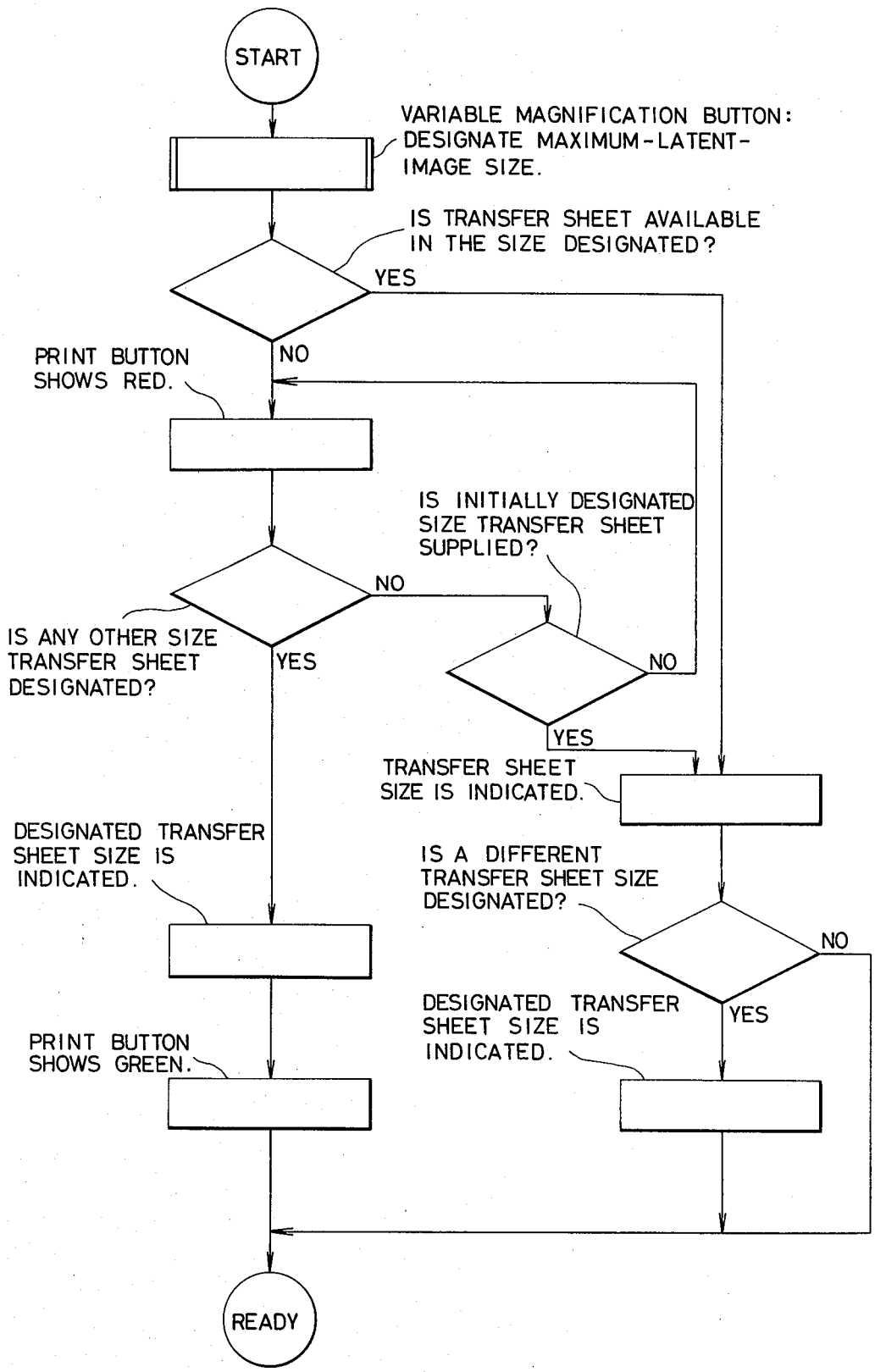
FIG. 3 is a flow chart showing the charge quenching operation of the electrophotographic copying in FIG. 1.

In reference to FIG. 3, the operation of the control apparatus 11 will now be explained. First, the CPU detects the maximum-latent-image size, in accordance with the information input thereto from the selected magnification button 13, and selects a cassette which holds the transfer sheets having the same size as that of the selected maximum-latent-image size. The size of the selected transfer sheets is displayed by one of the cassette size indication lamp 15. When there is no transfer sheet having the same size as that of the maximum-latent-image size, the CPU turns on the print button 16 in red, making the copying machine inoperative temporarily.

Thereafter, when the operator selects the transfer sheets with the desired size and depresses the transfer sheet selection button 14 indicating that desired size, the CPU selects a cassette holding the transfer sheets having that size, and the selected size is displayed by the cassette size indication lamp 15 indicating that size, and the print button 16 is lit in green, indicating that the copying machine is ready for copying. At this moment, the CPU compares the selected maximum-latent-image size with the selected transfer sheet size and stores in its memory device an on/off timing program for operating the charge quenching apparatus 4 to perform quenching of charges on the photoconductor 1 in accordance with the smaller size determined by the above-mentioned comparison, whereby during the copying process, the charge quenching apparatus 4 is energized or deenergized in accordance with the on/off timing program stored in the memory device, performing the required quenching of charges on the photoconductor 1.

Thus, in the invention, the maximum-latent-image size to be formed on the photoconductor 1 and the selected transfer sheet size are compared, and charges on the photoconductor 1 are quenched in accordance with the smaller size before development of the latent electrostatic image formed on the photoconductor 1. Therefore, even if the maximum latent image is smaller than the transfer sheet selected, no dark frames are formed on the copies obtained. Furthermore, when the maximum latent image is larger than the transfer sheet selected, the latent electrostatic image or any other charges in the area outside the area corresponding to the transfer sheet can be quenched, and therefore no toner is wasted, and the load which must be applied to the cleaning apparatus for cleaning the photoconductor 1 after the development can be significantly reduced. Scattering of toner from the surface of the photoconductor 1 during the cleaning process can also be reduced.

Figure 5:
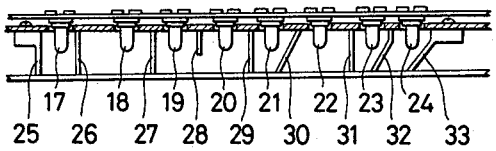
FIG. 5 is a sectional view of the charge quenching apparatus of the copying machine in FIG. 1.

FIG. 5 is a cross sectional view of the charge quenching apparatus 4. In the charge quenching apparatus 4, a plurality of quenching lamps 17 to 24 are aligned in the direction of the width of the photoconductor 1, and light shielding plates 25–33 restrict the illumination ranges of the quenching lamps 17–24, respectively. The charge quenching range in the direction of the width of the photoconductor 1 can be varied by selective lighting of the quenching lamps 17–24. The selective lighting is controlled by the control apparatus 11. Specifically, by comparing the maximum-latent-image size selected and the size of a transfer sheet to be employed, charges in the range corresponding to the smaller size on the photoconductor 1 are permitted to remain, while charges outside that range are quenched. For instance, in the unit magnification mode, when the unquenched range is of B4 size, only the quenching lamp 17 is lit, while when the unquenched range is of A4 size, the quenching lamps 17–20 are lit, and when the unquenched range is of B5 size, the quenching lamps 17–22 are lit.

In the variable magnification mode for making copies reduced in size, the maximum-latent-image areas for any copy size are made slightly small in comparison with the maximum-latent areas in the unit magnification. For instance, when an A3 size original is reduced to B4 size and the unquenched area on the photoconductor 1 is of B4 size, the quenching lamps 17 and 18 are lit. When an A3 size original is reduced to A4 size, and the unquenched area on the photoconductor 1 is of A4 size, the quenching lamps 17–21 are lit. Similarly, when a B4 size original is reduced to B5 size, and the unquenched area on the photoconductor 1 is of B5 size, the quenching lamps 17–23 are lit. When an A4 original is reduced to B5 size and the unquenched area on the photoconductor 1 is of B5 size, the quenching lamps 17–24 are lit. Charges in the range in the rotating direction of the photoconductor 1 are quenched by a mechanical shutter (not shown) which is operated by a solenoid actuated with the necessary timing which is determined by the control apparatus 11.

What is claimed is:

1. A charge quenching apparatus for use in an electrophotographic copying machine of the type capable of uniformly charging the surface of a photoconductor and forming a latent electrostatic image by projecting an optical image thereto and developing the latent electrostatic image and transferring the developed image to a transfer sheet, comprising:

a charge quenching device capable of quenching selectively charges on the surface of said photoconductor between the initial uniform charging of said photoconductor and the developing of said latent electrostatic image; and a control means for comparing the size of a maximum-latent-image area selected on said photoconductor with the size of a transfer sheet selected and selecting the smaller size and activating said charge quenching apparatus so as to quench charges on said photoconductor in the area in excess of the smaller size.

2. A charge quenching apparatus as in claim 1, wherein said control means comprises copy magnification selection means for selecting the size of a maximum-latent-image area, transfer sheet selecting means for selecting transfer sheets with the desired size, and a control circuit means for comparing the size of the maximum-latent-image area selected with the size of the transfer sheet selected, based on the signals indicating their respective sizes, which are input thereto from said copy magnification selection means and from said transfer sheet selection means, respectively, and for controlling the on/off timing of said charge quenching device.

3. A charge quenching apparatus as in claim 1, wherein said charge quenching device quenches unnecessary charges on said photoconductor after the step of charging uniformly said photoconductor and before the step of projecting an optical image to said photoconductor.

4. A charge quenching apparatus as in claim 1, wherein said charge quenching device quenches unnecessary charges on said photoconductor after the step of projecting an optical image to said photoconductor and before the step of developing the latent electrostatic image of the optical image.

* * * * *